US008282894B2

(12) United States Patent
Lee et al.

(10) Patent No.: US 8,282,894 B2
(45) Date of Patent: Oct. 9, 2012

(54) DROPLET EMITTING APPARATUS HAVING PIEZOELECTRIC VOLTAGE GENERATOR AND METHOD OF EMITTING A DROPLET USING THE SAME

(75) Inventors: Beom-seok Lee, Hwaseong-si (KR); Dustin Moon, Seongnam-si (KR); Jeong-gun Lee, Seoul (KR); Hye-jung Cho, Anyang-si (KR); In-seok Kang, Pohang-si (KR); Jin-seok Hong, Busan (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 140 days.

(21) Appl. No.: 12/141,988

(22) Filed: Jun. 19, 2008

(65) Prior Publication Data

US 2009/0189932 A1 Jul. 30, 2009

(30) Foreign Application Priority Data

Jan. 25, 2008 (KR) ..... 10-2008-0008033

(51) Int. Cl.
*B01L 3/00* (2006.01)

(52) U.S. Cl. ..... 422/500; 422/501; 422/502; 436/180

(58) Field of Classification Search ..... 422/99–100, 422/500–502; 347/46, 68; 436/180
See application file for complete search history.

(56) References Cited

U.S. PATENT DOCUMENTS

| | | | | |
|---|---|---|---|---|
| 3,924,947 | A * | 12/1975 | Hogg | 356/39 |
| 5,363,131 | A * | 11/1994 | Momose et al. | 347/46 |
| 6,036,305 | A * | 3/2000 | Nagasaki et al. | 347/86 |
| 2005/0100759 | A1 * | 5/2005 | Sumi | 428/689 |
| 2006/0166372 | A1 | 7/2006 | Preckel | |

FOREIGN PATENT DOCUMENTS

| | | | |
|---|---|---|---|
| JP | 2000-019184 | A | 1/2000 |
| JP | 2002-204945 | A | 7/2002 |
| KR | 10-2003-0016286 | A | 2/2003 |

OTHER PUBLICATIONS

Droplet Generator Crystal Drive Adjustment, IBM Technical Disclosure Bulletin, Oct. 1, 1978, pp. 1949-1950.*

* cited by examiner

*Primary Examiner* — Jyoti Nagpaul
(74) *Attorney, Agent, or Firm* — Sughrue Mion, PLLC

(57) ABSTRACT

Provided are a droplet emitting apparatus and a method of emitting droplets using the same. The apparatus includes a solution tank for containing a solution; a nozzle including an opening through which at least a droplet of the solution is emitted; and a voltage generator including a piezoelectric material for generating a voltage by instantaneous pressure application, wherein the voltage generated by the pressure to the piezoelectric material is applied to the solution in order for the at least a droplet of the solution to be emitted through the nozzle.

16 Claims, 8 Drawing Sheets

DROPLET EMITTING APPARATUS HAVING PIEZOELECTRIC VOLTAGE GENERATOR AND METHOD OF EMITTING A DROPLET USING THE SAME

CROSS-REFERENCE TO RELATED PATENT APPLICATION

This application claims the benefit of Korean Patent Application No. 10-2008-0008033, filed on Jan. 25, 2008, in the Korean Intellectual Property Office, the disclosure of which is incorporated herein in its entirety by reference.

BACKGROUND OF THE INVENTION

1. Field of the Invention

The present invention relates to a droplet emitting apparatus, and more particularly, to a droplet emitting apparatus for emitting at least a droplet onto a target object by using an electric charge concentration and a liquid bridge breakup, and a method of emitting a droplet using the apparatus.

2. Description of the Related Art

In general, a droplet emitting apparatus emits one or more very small droplets of a solution onto a target object such as a substrate or paper. There are a variety of techniques of emitting droplets, including an inkjet technique applied to an inkjet printer. However, since the inkjet technique involves applying heat to a solution (or ink), the inkjet technique is not appropriate for emitting a solution that may be denatured due to heat. In particular, it is necessary to develop a droplet emitting apparatus capable of emitting solutions without applying heat so that droplets of a solution containing biomolecules, such as nucleic acid, protein, bio-cells, viruses, or bacteria, may be emitted to manufacture specific materials, for example, bio-chips.

SUMMARY OF THE INVENTION

The present invention provides a droplet emitting apparatus, which emitting at least a droplet using electric charge concentration and liquid bridge breakup and has a piezoelectric voltage generator, and a method of emitting a droplet using the apparatus.

According to an aspect of the present invention using electrohydrodynamics, there is provided a droplet emitting apparatus including: a solution tank for containing a solution; a nozzle including an opening through which at least a droplet of the solution is emitted; and a voltage generator including a piezoelectric material generating a voltage by instantaneous pressure application, wherein the voltage generated by the pressure to the piezoelectric material is applied to the solution in order for the at least a droplet of the solution to be emitted through the nozzle.

The voltage generator may be constructed to generate a voltage of at least 1 kV.

The piezoelectric material may include a natural product, an artificial product, or a polymer. The natural product may be one selected from the group consisting of bernite, quartz, cane sugar, and dry bone. The artificial product may include one of $Pb(ZrTi)O_3$ and $PbTiO_3$. The polymer may be polyvinylidene fluoride (PVDF).

The nozzle may have the shape of a capillary tube and include a rear end immersed in the solution of the solution tank and a front end protruding from the solution tank, and the opening through which at least a droplet of the solution is emitted may be formed through the front and rear ends of the nozzle.

The droplet emitting apparatus may further include: a target mounting portion on which a target object onto which the solution is emitted is disposed to face the nozzle; and a distance adjusting unit for reciprocating the target object between a first position at which the target object is relatively close to the nozzle and a second position at which the target object is relatively far from the nozzle. When the target object is in the first position, a distance between the target object and the front end of the nozzle may be less than a critical distance which is the maximum distance at which a liquid bridge is formed between the target object and the front end of the nozzle due to the voltage applied to the solution, and when the target object is in the second position, the distance between the target object and the front end of the nozzle may be greater than a distance at which the liquid bridge breaks up.

The distance adjusting unit may move the target object from the second position to the first position and restores the target object to the second position, and the voltage generator may apply a voltage to the solution when the distance between the target object and the front end of the nozzle is the same as or greater than 0 and less than the critical distance.

The solution tank and the nozzle may be fixed, and the distance adjusting unit may move the target mounting portion to adjust the distance between the target object and the front end of the nozzle.

The target mounting portion may be fixed, and the distance adjusting unit may move the solution tank and the nozzle to adjust the distance between the target object and the front end of the nozzle.

The nozzle may protrude vertically from the solution tank, and the target mounting portion may be disposed over the nozzle.

The droplet emitting apparatus may include at least one more nozzle the same as the nozzle and installed in the solution tank. In this case, at least one more voltage generator may be provided in equal number to the nozzles, and the voltage generators may be electrically connected to the nozzles on a one-to-one basis.

The voltage for the voltage generator may be applied to the solution through a electrode dipped in the solution contained in the solution tank.

The voltage generator may be electrically connected to the nozzle.

The droplet emitting apparatus may further include a housing for containing the solution tank, the nozzle, and the voltage generator. In this case, the voltage generator may be disposed at one end of the interior of the housing, the nozzle may be disposed on the other side of the interior of the housing, and the solution tank may be disposed between the voltage generator and the nozzle in the housing.

According to another aspect of the present invention, there is provided a method of emitting a droplet. The method includes: reducing a distance between a target object onto which a solution contained in a solution tank is emitted and a nozzle through which to the solution is emitted until the distance is greater than 0 and equal to or less than a critical distance that is the maximum distance at which a liquid bridge is formed between the target object and a front end of the nozzle; preparing a voltage generator including a piezoelectric material; applying a pressure to the piezoelectric material to generate a voltage; applying the generated voltage to the solution to form the liquid bridge between the target object and the front end of the nozzle; and increasing the distance between the target object and the nozzle such that the liquid bridge breaks up to leave a droplet of the solution on the target object.

The speed of increasing the distance between the target object and the nozzle may be regulated to control the size of the droplet of the solution.

The nozzle or the target object may be moved to vary the distance between the target object and the nozzle.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
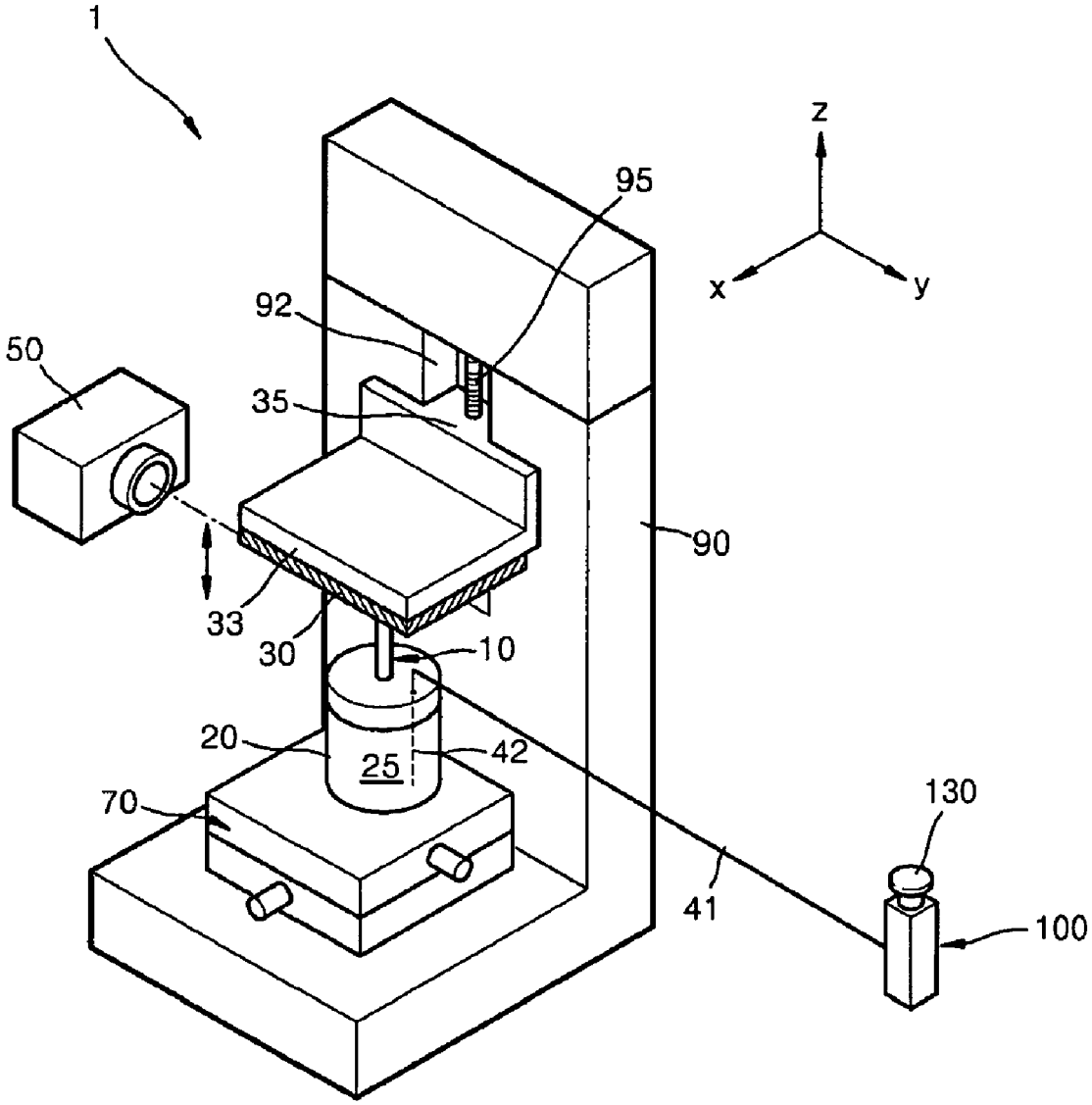
FIG. 1 is a perspective view of a droplet emitting apparatus according to an embodiment of the present invention.
Figure 2:
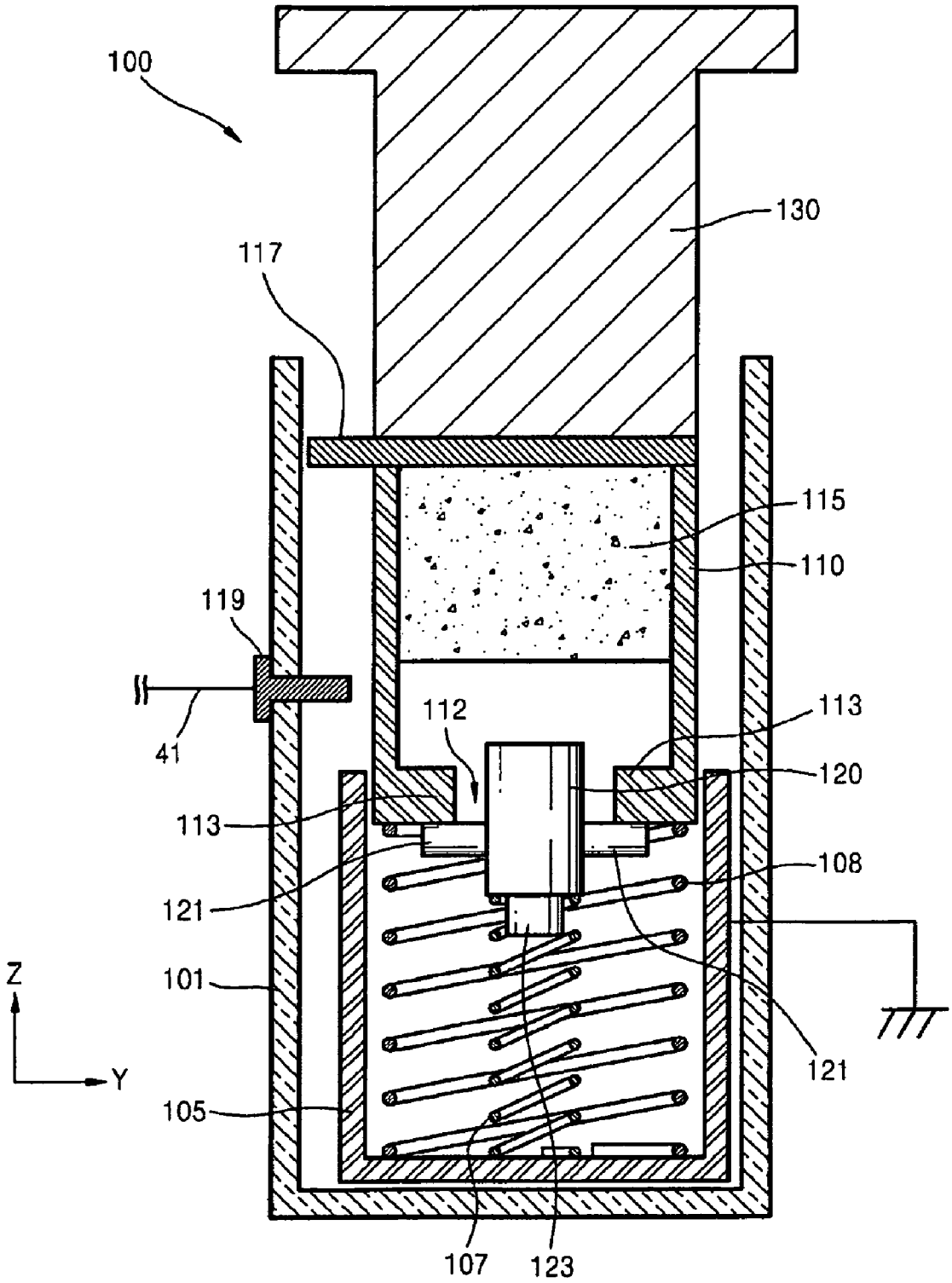
FIG. 2 is a cross-sectional view of a voltage generator of the droplet emitting apparatus illustrated in FIG. 1, according to an embodiment of the present invention.

FIG. 1 is a perspective view of a droplet emitting apparatus 1 according to an embodiment of the present invention. FIG. 2 is a cross-sectional view of a voltage generator 100 of the droplet emitting apparatus 1 illustrated in FIG. 1, according to an embodiment of the present invention.

Referring to FIG. 1, the droplet emitting apparatus 1 according to the current embodiment includes a solution tank 20 for containing a solution 25, a nozzle 10 including an opening (refer to 11 in FIG. 3A) through which one or more very small droplets of the solution 25 are emitted, and a voltage generator 100 for applying a voltage to the solution 25. The nozzle 10, which has the shape of a capillary tube, includes a rear end (refer to 12 in FIG. 3A) and a front end (refer to 13 in FIG. 3A). The rear end of the nozzle is immersed in the solution 25 contained in the solution tank 20, while the front end of the nozzle protrudes from the solution tank 20. The opening 11 is formed through the front end and the rear end of the nozzle.

A target object 30 onto which the droplets of the solution 25 are emitted is disposed opposite the front end of the nozzle 10. The target object 30 may be mounted on a target mounting portion 33. The target object 30 refers to a medium onto which droplets are emitted. For example, the target object 30 may be a hard plate formed of silicon, glass, metal, or plastic, or a flexible sheet formed of paper or a polymer film. At least one droplet is emitted through the opening 11 of the nozzle 10 and attached to the surface of the target object 30. When the droplet emitting apparatus 1 according to the current embodiment of the present invention is used to manufacture a biochip, such as a DNA microarray, the surface of the target object 30 may be coated with at least one material selected from a group consisting of an amine group, a carboxyl group, streptavidine, biotin, thiol, and poly-L-Lysine so as to improve the adhesiveness of bio-molecules contained in the droplet to be emitted.

Referring to FIG. 1, the nozzle 10 may be disposed vertically and protruding (i.e., in a z-axis direction) from the solution tank 20 such that the front end of the nozzle 10 faces upward. In this case, the target object 30 may be disposed over the front end 13 of the nozzle 10. However, the present invention is not limited thereto, and the nozzle 10 may be disposed in a diagonal direction, a horizontal direction, or a vertical direction such that the front end of the nozzle 10 faces downward. When the nozzle 10 is disposed vertically such that the front end of the nozzle 10 faces upward, the length of the portion of the nozzle 10 exposed above the surface of the solution 25 may be determined such that capillary force for drawing up the solution 25 in the nozzle 10 is greater than gravity.

The nozzle 10 may be formed of a conductive material or a nonconductive material. The conductive material may be a metal such as gold (Au), platinum (Pt), copper (Cu), or aluminum (Al), or a conductive polymer. The nonconductive material may be glass or a nonconductive polymer such as polycarbonate (PC) or polypropylene (PP). When the nozzle 10 is formed of a conductive material, the voltage generator 100 may apply a voltage to the solution 25 through lead lines (refer to 45A, 45B, 45C, and 45D in FIG. 5) that are directly connected to the nozzle 10.

When the nozzle 10 is formed of a nonconductive material, the voltage generator 100 may apply a voltage to the solution 25 through a dip electrode 42 that is dipped in the solution 25 contained in the solution tank 20 as illustrated in FIG. 1. Meanwhile, when the nozzle 10 is formed of a nonconductive material, a conductive material layer may be formed on an inner wall of the nozzle 10. In this case, the voltage generator 100 may apply a voltage to the solution 25 through the lead lines that are directly connected to the conductive material layer formed on the inner wall of the nozzle 10.

Referring to FIG. 2, the voltage generator 100 is a piezoelectric voltage generator in which a piezoelectric material generates a voltage due to instantaneous pressure application. The voltage generator 100 includes a case 101, a fixed member 105, which is fixed to the interior of the case 101 and has a top opening, a inner member 110, which is partially inserted into the top opening of the fixed member 105 and capable of moving up and down, and a push button 130, which allows the inner member 110 to descend. Also, a bottom through hole 112 and a projection 113 are formed in a bottom surface of the inner member 110, and a piezoelectric material 115 is inserted in the inner member 110. The piezoelectric material 115 may be formed of a natural product, an artificial product, or a polymer. The natural product may be, for example, one selected from the group consisting of bernite, quartz, cane sugar, and dry bone. The artificial product may be, for example, one of $Pb(ZrTi)O_3$ and $PbTiO_3$. The polymer may be, for example, polyvinylidene fluoride (PVDF).

Also, the voltage generator 100 may include a hammer 120 for striking the piezoelectric material 115, a hammer spring 107 for elastically supporting the hammer 120, and a restoration spring 108 for restoring the inner member 110 to its original position. The hammer 120 includes a pair of hammer wings 121, which protrude on both sides of the hammer 120, and a spring support protrusion 123, which prevents the hammer spring 107 from deviating from its original position.

When the push button 130 is pressed downward, the inner member 110 moves downward and is inserted into the fixed member 105. Also, the hammer wings 121 are caught by the projection 113 of the inner member 110 so that the hammer 120 also moves downward. During the descent of the inner member 110 and the hammer 120, one of the inner member 110 and the hammer 120 rotates about the Z-axis. Thus, the hammer wings 121 of the hammer 120 become separated from the projection 113. The rotation of the inner member 110 or the hammer 120 may be performed by moving the inner member 110 or the hammer 120 upward or downward along an appropriate guide (not shown).

When the hammer wings 120 are separated the projection 113, the hammer 120 strikes the piezoelectric material 115 due to the elasticity of the hammer spring 107 to generate a voltage of at least 1 kV. In this case, an electrode 117 combined with the piezoelectric material 115 is electrically connected to a terminal 119 due to the descent of the inner member 110, so that the generated voltage is applied to the solution 25 along a lead line 41. Meanwhile, another electrode of the voltage generator 100 is grounded by the hammer 120, the hammer spring 107, and the fixed member 105, which are formed of a conductive material. When the push button 130 is released, the inner member 110 is restored to its original position illustrated in FIG. 2 due to the elasticity of the restoration spring 108. Since the piezoelectric voltage generator 100 is inexpensive, the fabrication cost of the droplet emitting apparatus 1 can be reduced.

Referring again to FIG. 1, the droplet emitting apparatus 1 includes a distance adjusting unit, which varies a distance (refer to "d" in FIG. 3A) between the target object 30 and the front end of the nozzle 10 at a predetermined speed. In the current embodiment of the present invention, the distance adjusting unit includes a mechanism capable of reciprocating the target mounting portion 33 vertically (i.e., in the z-axis direction). The mechanism may include a linear geared motor (not shown) or a linear motor (not shown), which moves the target mounting portion 33 using a gear 95. For example, as illustrated in FIG. 1, a portion of the target mounting portion 33 is connected to the gear 95 and receives power and moves along a guide 92 of a frame 90.

The present invention is not limited to the above construction. For example, the distance adjusting unit may include a mechanism capable of fixing the target mounting portion 33 on which the target object 30 is mounted and moving the nozzle 10 along with the solution tank 20 or a mechanism capable of moving both the target mounting portion 33 and the nozzle 10. Since the construction of a mechanism of the distance adjusting unit can be easily designed by one of ordinary skill in the art, a detailed description thereof will be omitted.

The solution tank 20 may be mounted on a movable mount 70. The movable mount 70 moves the solution tank 20 horizontally on an x-y plane to vary a position of the target object 30 on which a droplet is emitted. Meanwhile, the droplet emitting apparatus 100 may or may not further include a camera 50 for monitoring the emitted droplet.

FIGS. 3A through 3D are cross-sectional views illustrating a method of emitting droplet, according to an embodiment of the present invention. The method illustrated in FIGS. 3A through 3D is performed using the droplet emitting apparatus illustrated in FIG. 1.

Figure 3A:
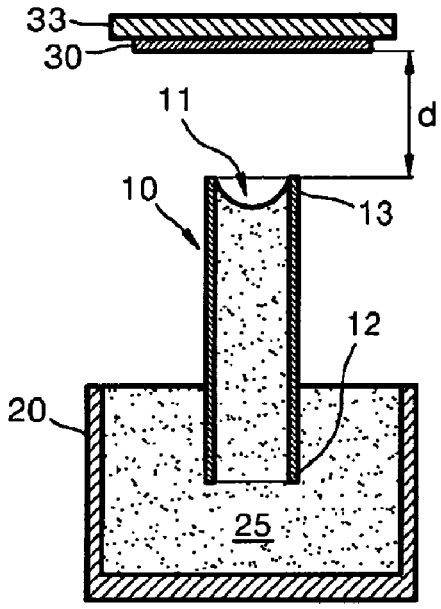
FIGS. 3A through 3D are cross-sectional views illustrating a method of emitting a droplet, according to an embodiment of the present invention.

Referring to FIG. 3A, the solution 25 contained in the solution tank 20 is transferred due to capillary force through the opening 11 formed between the rear end 12 of the nozzle 10 having a capillary shape and the front end 13 of the nozzle 10. In this case, the rear end 12 of the nozzle 10 is dipped in the solution 25, while the front end 13 of the nozzle 10 is exposed above the surface of the solution 25. When the solution 25 reaches the front end 13 of the nozzle 10, the solution 25 does not overflow out of the front end 13 of the nozzle 10 due to surface tension. In this case, a surface shape of the solution 25 formed in the front end 13 of the nozzle 10 may have various shapes according to a contact angle of the nozzle 10 with the solution 25.

Figure 3B:
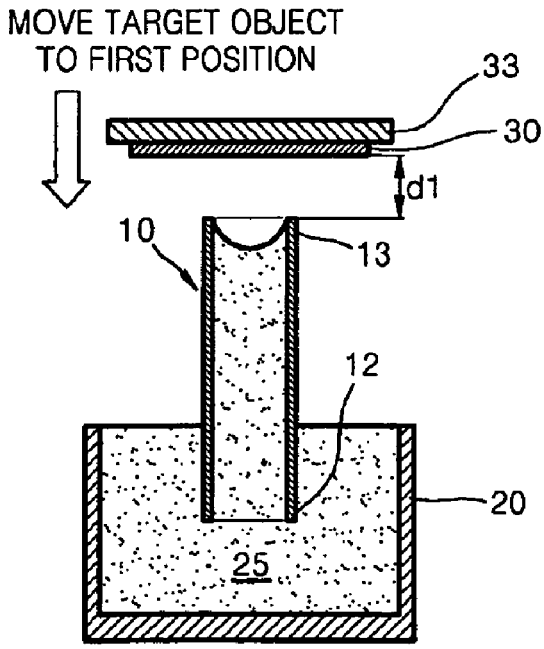

Referring to FIG. 3B, when the solution 25 is supplied to the front end 13 of the nozzle 10, the target object 30 is moved along with the target mounting portion 33 in the arrow direction to bring the target object 30 close to the nozzle 10. Thus, the target object 30 reaches a first position so that the distance "d" between the surface of the target object 30 and the front end 13 of the nozzle 10 becomes shorter than a critical distance. In other words, a distance d1 between the target object 30 and the front end 13 of the nozzle 10 is shorter than the critical distance in the first position. Here, the critical distance refers to the maximum distance at which a liquid bridge (refer to 26 in FIG. 3C) can be formed between the nozzle 10 and the target object 30 when a predetermined voltage is applied to the solution 25. The critical distance depends on various factors, such as the characteristics of the solution 25, the characteristics of the applied voltage, and the diameter of the nozzle 10.

Figure 3C:
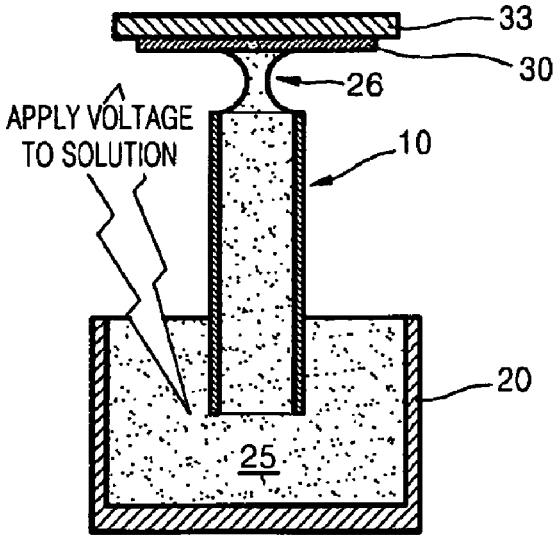

Referring to FIG. 3C, when the target object 30 reaches the first position, the push button 130 of the voltage generator 100 is pressed to generate a voltage of at least 1 kV, so that the generated voltage is applied to the solution 25. As a result, charges concentrate on the surface of the solution 25 formed in the front end 13 of the nozzle 10 and simultaneously, relative charges are induced in the surface of the target object 30 adjacent to the surface of the solution 25 formed in the front end 13 of the nozzle 10. In this case, the surface of the solution 25 in the front end 13 of the nozzle 10 is deformed due to an electrical attraction (i.e., a Coulomb force) between the surface of the solution 25 and the surface of the target object 30, and brought into contact with the surface of the target object 30, thereby forming the liquid bridge 26.

Figure 3D:
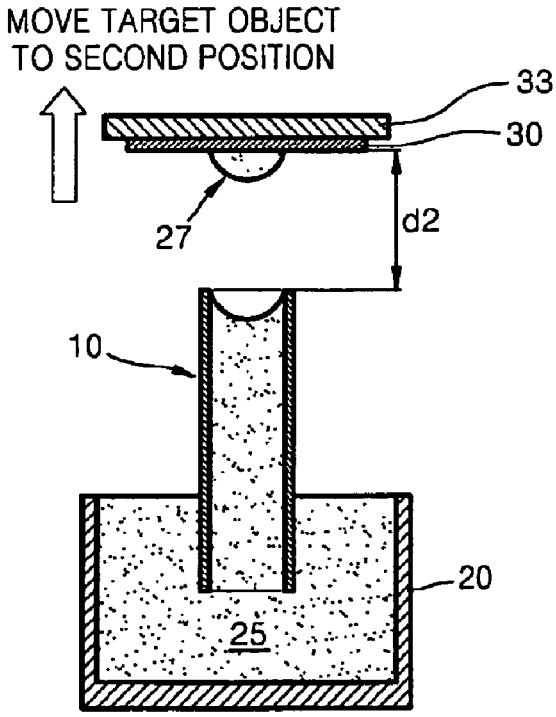

Referring to FIG. 3D, during or after the formation of the liquid bridge 26, the target object 30 is moved to a second position so that the target object 30 is spaced apart from the nozzle 10. When the target object 30 is in the second position, a distance d2 between the target object 30 and the front end 13 of the nozzle 10 is greater than a distance at which the breakup of the liquid bridge 26 occurs. In other words, while the target object 30 is moving to the second position, the liquid bridge 26 breaks up and a droplet 27 of the solution 25 remains on the surface of the target object 30.

Figure 4:
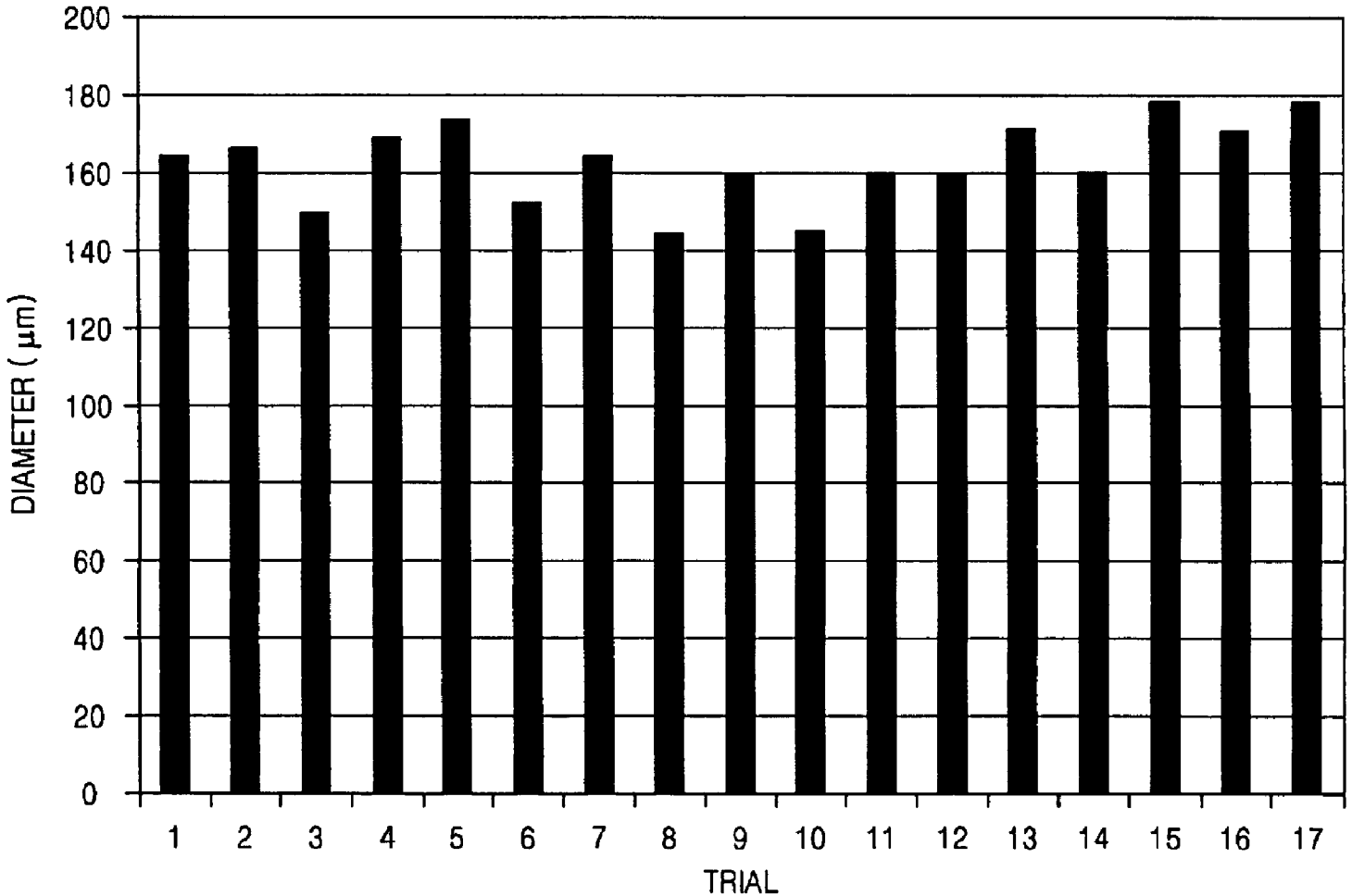
FIG. 4 is a graph of distribution of diameters of droplets emitted by the droplet emitting apparatus illustrated in FIG. 1.

FIG. 4 is a graph of distribution of diameters of droplets emitted by the droplet emitting apparatus 1 illustrated in FIG. 1.

In this case, when the voltage generator 100 was operated to generate a voltage, the droplet emitting apparatus 1 repetitively emitted droplets 17 times using the nozzle 10 having the opening 11 with an outer diameter of 460 μm and an inner diameter of 230 μm under the same conditions. As a result, the droplet emitting apparatus 1 emitted droplets with an average diameter of about 162.7 μm, a standard deviation of 10.4 μm, and a percent coefficient of variance (% CV) of 6.4%, which are better than in the conventional art.

Figure 5:
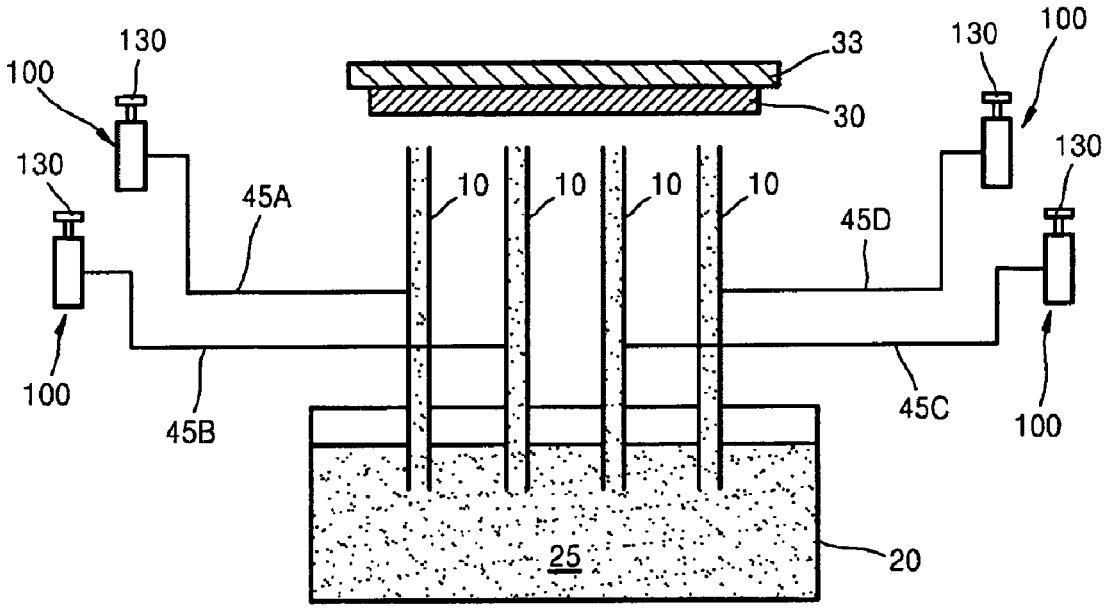
FIG. 5 is a schematic view of a droplet emitting apparatus including a single solution tank and a plurality of capillary nozzles, according to an embodiment of the present invention.

FIG. 5 is a schematic view of a droplet emitting apparatus, according to an embodiment of the present invention.

Referring to FIG. 5, the droplet emitting apparatus according to the current embodiment of the present invention includes a single solution tank 20 and a plurality of capillary nozzles 10. The nozzles 10, in the shape of capillary tubes, are installed in the single solution tank 20, and a plurality of voltage generators 100 are also provided in equal number to the nozzles 10. Also, the voltage generators 100 are electrically connected to the nozzles 10 through lead lines 45A, 45B, 45C, and 45D on a one-to-one basis. By pressing a push button 130 of each of the voltage generators 100 automatically or manually, the droplet emitting apparatus 1 can emit droplets onto a target object 30 without causing errors.

Figure 6:
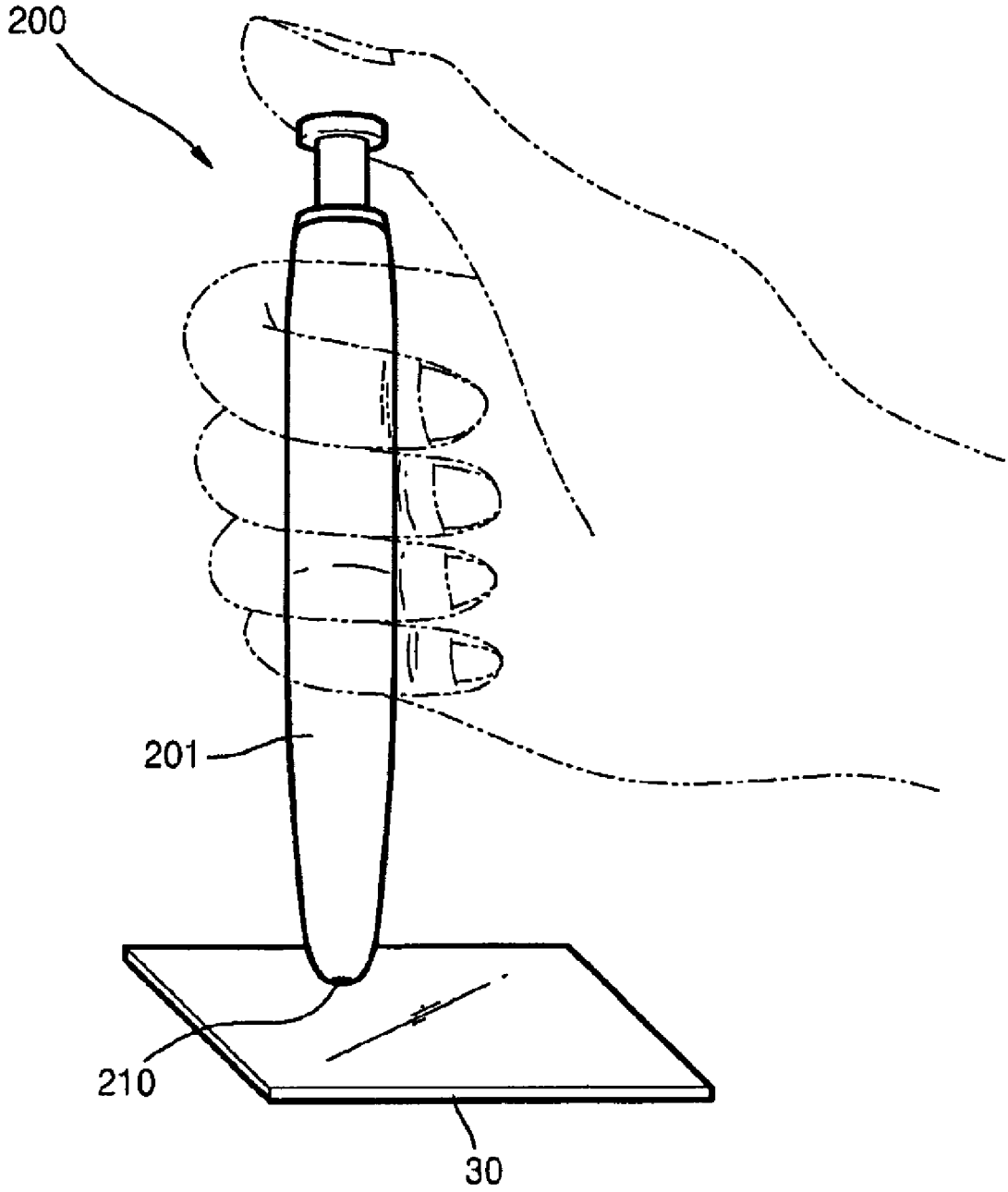
FIGS. 6 and 7 are respectively a perspective view and a cross-sectional view of a droplet emitting apparatus according to another embodiment of the present invention.
Figure 7:
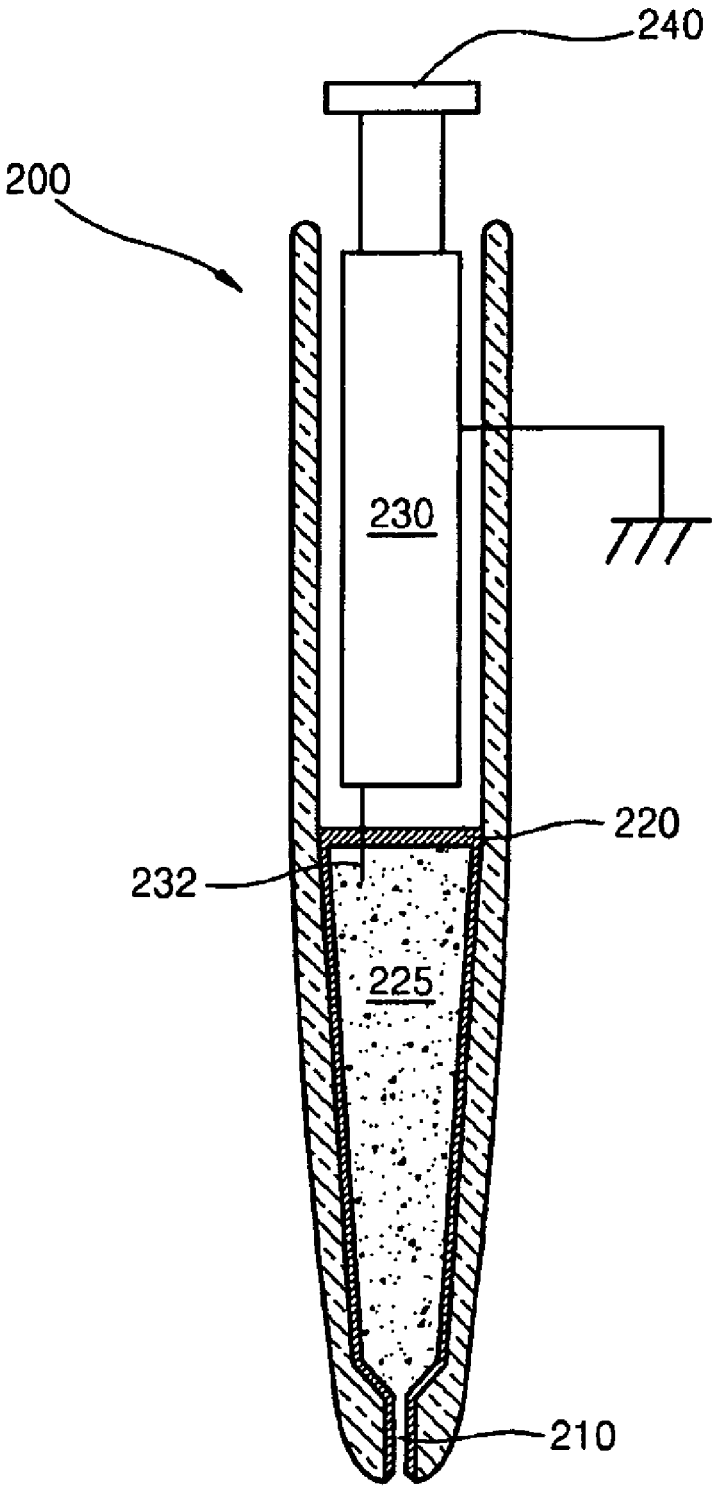

FIGS. 6 and 7 are respectively a perspective view and a cross-sectional view of a droplet emitting apparatus 200, according to another embodiment of the present invention.

Referring to FIGS. 6 and 7, the droplet emitting apparatus 200 according to the current embodiment of the present invention is a pen-type portable apparatus capable of emitting droplets onto a target object 30 that is provided in the form of a substrate. Also, although not shown in the drawings, the droplet emitting apparatus 200 may be used to emit a solution containing a medicine onto a target object, for example, the surface of the skin.

Referring again to FIGS. 6 and 7, the droplet emitting apparatus 200 according to the current embodiment of the present invention includes a pen-type housing 201, a solution tank 220 contained in the housing 201, a nozzle 210, and a voltage generator 230. The voltage generator 230 is disposed at one end of the interior of the housing 201, the nozzle 210 is disposed at the other end of the interior of the housing 201, and the solution tank 220 for containing a solution 225 is disposed between the voltage generator 230 and the nozzle 210 in the housing 201. A push button 240 of the voltage generator 230 protrudes outward from one end of the housing 201. A dip electrode 232 extends from the voltage generator 230 into the solution tank 220 in order to apply a voltage to the solution 225, and another electrode (not shown) of the voltage generator 230 is grounded. The solution tank 220, the nozzle 210, and the voltage generator 230 are downscaled in size as compared to the solution tank 20, the nozzle 10, and the voltage generator 100 illustrated in FIG. 1. However, the structures and functions of the solution tank 220, the nozzle 210, and the voltage generator 230 are the same as in FIG. 1 and thus, descriptions thereof will be omitted.

A method of emitting a droplet using the droplet emitting apparatus 200 will now be described. Initially, the droplet emitting apparatus 200 is held with the hand and the nozzle 210 is brought close to the target object 30 such that a distance between the nozzle 210 and the target object 30 is greater than 0 and equal to or less than a critical distance. Next, the push button 240 of the voltage generator 230 is pressed to apply a voltage to the solution 225 of the solution tank 220, thereby forming a liquid bridge (refer to 26 in FIG. 3C). After that, the nozzle 210 is spaced apart from the target object 30 to cause the breakup of the liquid bridge 26, thereby leaving a droplet (refer to 27 in FIG. 3D) on the target object 30.

While the present invention has been particularly shown and described with reference to exemplary embodiments thereof, it will be understood by one of ordinary skill in the art that various changes in form and details may be made therein without departing from the spirit and scope of the present invention as defined by the following claims.

What is claimed is:

1. A droplet emitting apparatus using electrohydrodynamics comprising:

a solution tank for containing a solution;

a nozzle comprising an opening through which at least a droplet of the solution is emitted;

a voltage generator for generating a voltage by applying instantaneous pressure to a piezoelectric material, wherein the voltage generated by the pressure to the piezoelectric material is applied to the solution through an electrode in order for the at least a droplet of the solution to be emitted through the opening of the nozzle to a target object by an electrical attraction between the solution and the target object;

a target mounting portion on which the target object onto which the solution emitted is disposed to face the nozzle; and a distance adjusting unit for reciprocating the target object between a first position at which the target object is relatively close to the nozzle and a second position at which the target object is relatively far from the nozzle, wherein, when the target object is in the first position, distance between the target object and the front end of the nozzle is less than a critical distance which is the maximum distance at which a liquid bridge is formed between the target object and the front end of the nozzle due to the voltage applied to the solution, and when the target object is in the second position, the distance between the target object and the front end of the nozzle is the same as or greater than a distance at which the liquid bridge breaks up.

2. The apparatus of claim 1, wherein the voltage generator is constructed to generate a voltage of at least 1 kV.

3. The apparatus of claim 1, wherein the piezoelectric material comprises at least one selected from the group consisting of a natural product, an artificial product, and a polymer.

4. The apparatus of claim 3, wherein the natural product is one selected from the group consisting of bernite, quartz, cane sugar, and dry bone.

5. The apparatus of claim 3, wherein the artificial product comprises one of $Pb(ZrTi)0_3$ and PbTiO3.

6. The apparatus of claim 3, wherein the polymer is polyvinylidene fluoride (PVDF).

7. The apparatus of claim 1, wherein the nozzle has the shape of a capillary tube and comprises a rear end immersed in the solution of the solution tank and a front end protruding from the solution tank, and the opening through which the at least a droplet of the solution is emitted is formed through the front and rear ends of the nozzle.

8. The apparatus of claim 7, further comprising at least one more nozzle the same as the nozzle and installed in the solution tank, and at least one more voltage generators provided in equal number to the nozzles, wherein the voltage generators are electrically connected to the nozzles on a one-to-one basis.

9. The apparatus of claim 1, wherein the distance adjusting unit moves the target object from the second position to the first position and restores the target object to the second position, and the voltage from the voltage generator is applied to the solution when the distance between the target object and the front end of the nozzle is greater than 0 and less than the critical distance.

10. The apparatus of claim 1, wherein the solution tank and the nozzle are fixed, and the distance adjusting unit moves the target mounting portion to adjust the distance between the target object and the front end of the nozzle.

11. The apparatus of claim 1, wherein the target mounting portion are fixed, and the distance adjusting unit moves the solution tank and the nozzle to adjust the distance between the target object and the front end of the nozzle.

12. The apparatus of claim 1, wherein the nozzle protrudes vertically from the solution tank, and the target mounting portion is disposed over the nozzle.

13. The apparatus of claim 1, wherein the voltage generator applies a voltage to the solution through a electrode dipped in the solution contained in the solution tank.

14. The apparatus of claim 1, wherein the voltage generator is electrically connected to the nozzle.

15. The apparatus of claim 1, further comprising a housing for containing the solution tank, the nozzle, and the voltage generator, wherein the voltage generator is disposed at one end of the interior of the housing, the nozzle is disposed at the other end of the interior of the housing, and the solution tank is disposed between the voltage generator and the nozzle in the housing.

16. The apparatus of claim 1, wherein the voltage generator further comprises:

a hammer for striking the piezoelectric material; and a hammer spring for elastically supporting the hammer.

* * * * *